US007931775B2

(12) United States Patent
Clark et al.

(10) Patent No.: US 7,931,775 B2
(45) Date of Patent: Apr. 26, 2011

(54) SURFACE TREATMENT DEVICE

(75) Inventors: Daniel Clark, Derby (GB); Stephen Tuppen, Swadlincote (GB); Christopher Wynn, Alfreton (GB)

(73) Assignee: Rolls-Royce PLC, London (GB)

( * ) Notice: Subject to any disclaimer, the term of this patent is extended or adjusted under 35 U.S.C. 154(b) by 888 days.

(21) Appl. No.: 11/790,410

(22) Filed: Apr. 25, 2007

(65) Prior Publication Data

US 2008/0035179 A1 Feb. 14, 2008

(30) Foreign Application Priority Data

May 23, 2006 (GB) ..... 0610157.0

(51) Int. Cl.
*B08B 9/00* (2006.01)

(52) U.S. Cl. ..... 156/345.21; 134/29

(58) Field of Classification Search ..... 134/29, 134/114, 137, 160, 164, 28, 34, 42, 43, 44; 156/345.51, 345.21, 345
See application file for complete search history.

(56) References Cited

U.S. PATENT DOCUMENTS

| | | | | |
|---|---|---|---|---|
| 4,001,892 | A * | 1/1977 | Castelli et al. | 360/133 |
| 5,225,246 | A | 7/1993 | Beers et al. | |
| 2002/0121289 | A1 * | 9/2002 | Brown et al. | 134/6 |
| 2003/0035728 | A1 | 2/2003 | Das et al. | |

FOREIGN PATENT DOCUMENTS

EP 1 256 635 A1 11/2002

* cited by examiner

*Primary Examiner* — Sylvia R. MacArthur
(74) *Attorney, Agent, or Firm* — Oliff & Berridge, PLC

(57) ABSTRACT

A surface treatment device (10) is provided for applying a surface treatment medium to an article (60). The device comprises an application member (12, 14) for holding and applying the surface treatment medium to the article. The device has a securing arrangement (40) for securing the application member to the article.

20 Claims, 9 Drawing Sheets

SURFACE TREATMENT DEVICE

This invention relates to surface treatment devices. More particularly, but not exclusively, this invention relates to surface treatment devices for applying etching media to articles, such as metallic articles. Embodiments of this invention relate to surface treatment devices for applying etching media to prepared region of fan blades.

Gas turbine engines incorporate combined discs and blades, where the blades are integrally mounted on the disc. These components are known in the art as "blisks". It is likely that these blisks will suffer damage during normal service, and repair or salvage operations may be required to refurbish them up. This typically involves metal deposition or other suitable welding process. The reason to be repaired is generally the leading edge of the aerofoil blade of the sections of the blisk blade. A local post repair or post salvage heat treatment process is required to relieve the stress of the repair. Also it is often necessary to apply an etching medium to the blisk in order to remove the inherent surface oxide layer, known as the 'alpha case'.

The known processes for applying the etching medium involve the use of processing tanks. These can often be bulky and require large quantities of chemicals which have a negative environmental impact.

According to one aspect of this invention, there is provided a surface treatment device for applying a surface treatment medium to an article, the surface treatment device comprising an application member for holding and applying the surface treatment medium to the article and a securing arrangement for securing the application member to the article.

The surface treatment medium may comprise an etching medium, which may be acidic, and may comprise acids such as nitric acid and/or hydrofluoric acid.

The surface treatment device may comprise first and second application members for applying the medium to first and second regions of the article. The first and second application members may be generally opposite each other to apply the medium to first and second opposite sides of the article.

The first and second application members may be pivotally attached to one another to allow pivotal movement of the first and second application members relative to each other. Alternatively, the first and second treatment members may be integrally fixed to one another, for example by being cast as a one-piece feature, for example, but injection moulding or a rapid prototyping technique.

The securing arrangement may comprise an urging member to urge the, or each, application member in to engagement with the article. The urging member may comprise a spring.

In one embodiment, the urging member is connected to the first and second application members. Each of the first and second application members may comprise a holding portion, in which the surface treatment medium can be held. Each of the first and second application members may comprise a reaction portion in engagement with the urging member to be moved by the urging member thereby moving the holding portion.

The holding portion may extend on one side of the pivot, and a reaction portion may extend on the opposite side of the pivot.

In another embodiment, the securing arrangement may comprise a clamp, having a clamping member. The clamp may comprise first and second clamping members, each clamping member being provided to engage a respective one of the first and second application members. In this embodiment, the urging member may be provided on the clamping arrangement.

A mixing arrangement may be provided in the application members to mix the medium. In one embodiment, the mixing arrangement may comprise an elongate element, such as a wire, extending across at least one of the first and second application members. The elongate element may extend across both of the first and second application members. A control may be provided to control movement of the elongate element. The control may comprise magnet arrangement. The control may comprise first and second magnets each arranged on a respective one of the first and second application members, the magnets being movable along the first and second application members, to move the elongate member therewith.

The elongate element may include an inert coating such as polypropylene. The elongate element may be helical and may be formed of a resilient material. The elongate element may be rotatable, and may include features to allow it to be rotatable, such as one or more tabs.

In another embodiment, the mixing arrangement may comprise a button on the application member. The button may be depressable to cause a flow of the surface treat medium in the application medium, thereby mixing the surface treatment medium. The button may comprise a gland. The button may comprise a flexible polymer material. The button may be convex. Mixing members, such as bristles, may be provided within the button to enhance the mixing.

The mixing arrangement may comprise a pair of the aforesaid buttons, arranged adjacent one another on the application member.

The, or each, application member may comprise a carrier to carry the medium. The carrier may comprise a powder material, such as titanium dioxide, alumina, silica, zirconia, calcium fluoride. The amount of titanium dioxide used as the carrier will determine the viscosity of the mixture.

In another embodiment, the, or each of the first and second application members may be provided with inlet apertures to allow a flow of the surface treatment medium therethrough.

According to another aspect of this invention, there is provided a method of treating the surface of an article comprising applying a surface treatment device as described above to the article, wherein a surface treatment medium is held by the surface treatment device and treats the surface of the article.

The method may include preconditioning treatment, in which the surface treatment medium may comprise a preconditioning medium, such as a sodium hydroxide solution.

The method may comprise mounting the surface treatment device on a support arrangement.

The method may comprise disposing the surface treatment medium in the surface treatment device such that the surface treatment media treats the surface of the article when the surface treatment device is applied thereto.

The method may comprise providing a paste of the surface treatment medium, and disposing the paste in the surface treatment device for application to the article.

In one embodiment, a first treatment medium may be provided to the, or each, application member. The first treatment medium may be a preconditioning medium, which may be capable of reacting with the surface oxide layer. The first treatment medium may comprise a sodium hydroxide and sodium chromate solution.

After treatment with the first treatment medium, the first treatment medium may be removed, for example by applying water to the, or each, application member.

The second treatment medium may be supplied to the, or each, application member. The second treatment medium may be supplied via the inlet apertures. The second treatment medium may comprise an etching medium.

After the second treatment medium has been applied to the article, the second treatment medium may be removed, for example by flushing the, or each, application member with water.

Alternatively, the, or each, application member may be provided with the etching medium held therein prior to use.

The, or each, application member may include a liner on which the surface treatment medium can be held. The liner may be formed of a suitable polymeric material, for example, polypropylene.

Seals may be provided around the edges of the, or each, application member. The seals may comprise wax. The wax may be a mouldable wax, and may be water, or non-water, washable. A suitable such sealant is sold under the trade mark Turco wax lacquer by Ely Chemicals.

In another embodiment, a paste comprising the surface treatment medium may be applied to a substrate. The substrate may be a tape of a polymeric material, such as polypropylene, or a tape, or foil, of a metallic material. The metallic material may be an electrochemically stable material, or a material that is substantially electrochemically stable during the method. The substrate may comprise outwardly extending tabs upon which an adhesive is provided to adhere the surface treatment device to the article.

In another embodiment, a dispenser may be provided in which the surface treatment medium is held. The dispenser may be formed of a ceramic material, such as aluminosilicate, and may be shaped to conform to the surface of the article to be treated.

The dispenser could be formed in situ by casting.

Passage forming members may be provided in the ceramic material to create passages for the medium. The passage forming members may comprise rods, such as glass rods.

The surface treatment device may be arrangeable over the dispenser, to hold the dispenser on the article. The surface treatment medium may be supplied to the dispenser. The ceramic material is preferably porous to allow the surface treatment medium to pass therethrough.

According to another aspect of this invention, there is provided a surface treatment assembly comprising a surface treatment device as described above, and a support arrangement for supporting the surface treatment device on an article.

The support arrangement may comprise a jig, and may include a main support member for supporting the surface treatment device, and subsidiary support members to support the main support member.

The main support member may comprise an elongate member having a plurality of fixing formations thereon, and each of which a surface treatment device can be fixed.

Alternatively, the support assembly may comprise a base member mountable on the article, and a plurality of upwardly extending support members capable of supporting a clamp. Each of the support members may be in the form of a tubular member, and may comprise a plurality of fixing portions at which the clamping member can be secured.

Guide members may be provided to guide the clamping member on to the surface treatment device.

Embodiments of the invention will now be described by way of example only, with reference to the accompanying drawings, in which.

Figure 1:
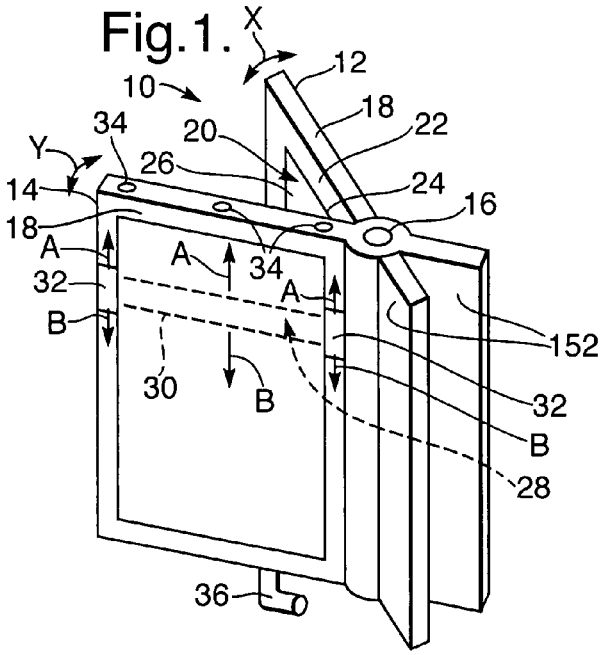
FIG. 1 is a diagrammatic view of a surface treatment device.
Figure 2:
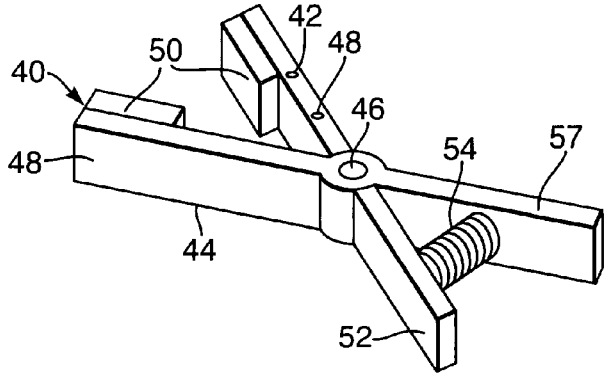
FIG. 2 is a diagrammatic view of a securing arrangement for securing the surface treatment device to an article.

Referring to FIG. 1, there is shown a surface treatment device 10 in the form of a cassette comprising a first application member 12, and a second application member 14. The first and second application members 12, 14 are connected to one another at a pivot 16, and can pivotally move relative to one another as shown by the arrows X and Y.

A first portion of each of the first and second application members 12, 14 extends on one side of the pivot 16, and provides a holding portion 18 for a surface treatment medium 20. A second portion 21 of each of the first and second application members extends on the opposite side of the pivot 16 and provide reaction members 152 for springs to clamp the surface treatment device on articles as explained below in connection with FIG. 6.

Although the surface treatment medium 20 is seen only on the first application member 12, it will be appreciated that it will be provided also on the second holding portion of the application member 14.

A water soluble wax sealant 22 is provided around the edge regions of each of the holding portions 18. An inner liner 24, for example formed of a polypropylene material is provided around the inner edge of the sealant 22.

A paste 26 is held within the liner 24, and comprises a surface treatment medium in the form of an etching medium, to be applied to an article to be treated. The article may be, for example, a fan blade of a gas turbine engine. The etching medium 26 comprises hydrofluoric acid, nitric acid and a powder material, such as titanium dioxide to provide a paste to the desired thickness. The amounts of the acid and the powder can be adjusted to provide the desired thickness of the paste 26.

Mixing means 28 is provided in each of the first and second application members 12, 14 and comprises an elongate steel wire 30 as shown in broken lines, and a pair of magnets 32. The wire 30 extends across the holding portions 18 of the first and second application members 12, 14. The magnets 32 are connected to a suitable motor and can move up and down the application member as shown by the arrows A, B to move the metallic wire 30 also in the direction of the arrows A, B to stir the paste within the holding portions 18. The stirring of the paste provides the advantage in this embodiment that it helps to prevent the formation of electrochemically passivated regions, and/or regions where the paste is detached from the workpiece.

If desired, the holding portions 18 of the first and second application members 12, 14 can be provided with inlets 34 and outlets 36 to allow a liquid to pass into and out of the respective holding members 18. In an alternative embodiment, instead of the holding members holding a paste 20 of the etching medium, the holding members could hold the powdered material, and the etching, or other medium could be supplied to the respective holding portions 18 as desired. After the etching medium has been applied to the article, the etching medium could be flushed out by passing water into the holding portions 18 through the inlet apertures 34 and out of outlet apertures 36.

In order to secure the cassette 10 onto the article, a securing arrangement in the form of a clamp 40 is provided. The clamp 40 comprises first and second mounting members 42, 44 which are pivotally attached to each other at a pivot 46. Each of the clamping members 42, 44 comprises a first portion in the form of an engaging portion 48 extending on one side of the pivot. Engaging members 50 are provided on the free ends of the engaging portions 48.

A second portion, in the form of a reaction portion 52, of each of the first and second mounting members 42, 44 extends on the opposite side of the pivot 46 to the engaging portion 48.

The clamp 40 is arranged such that the engaging members 50 engage the holding portions 18 of the first and second application members 12, 14. The spring 54 urges the reaction portions inwardly, thereby urging the engaging portions inwardly to clamp the engaging members 50 onto the holding portion 18 of the first and second application members 12, 14. In this way, the surface treatment device 10 is secured to the article to be treated.

Figure 3:
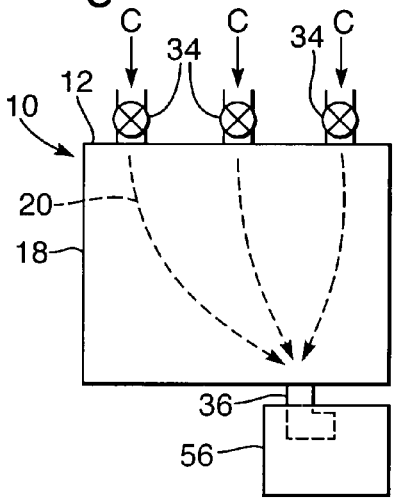
FIG. 3 shows another embodiment of a surface treatment device.

FIG. 3 shows a further embodiment of the cassette 10 in which a liquid medium is supplied to the holding portions 18 of the first application member 12 via the inlet apertures 34, as shown by the arrows C.

The liquid passes out of the first application member 12 via the outlet 36 to a waste tank 56 to enable the etching medium to be disposed of.

Figure 4:
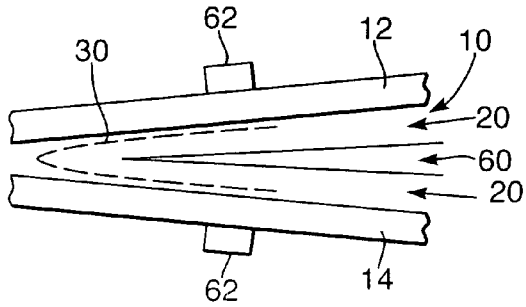
FIG. 4 shows a sectional top view of a part of a surface treatment device.

FIG. 4 shows a sectional top view of a further embodiment of a cassette 10 applied to a leading edge of a fan blade 60. An elongate wire 30 is provided in the paste 20 and around the leading edge of the fan blade 60. The pair of magnets 32 on each of the application members 12, 14, as shown in FIG. 1, is replaced by a single magnet 62 on each of the first and second application members 12, 14 and the elongate wire 30 is moved up and down by the up and down movement of the magnets 62.

Figure 5:
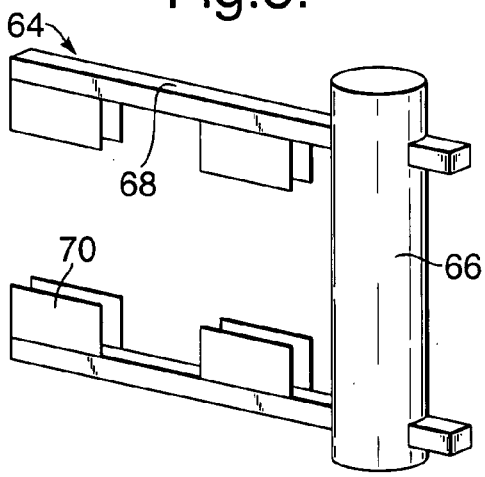
FIG. 5 is a diagrammatic view of a support assembly for a surface treatment device.

FIG. 5 shows a support arrangement in the form of a jig 64 upon which one or more cassettes 10 can be mounted. The jig 64 comprises a main support member 66 and upper and lower subsidiary support members 68, 70. The cassette 10 is mounted on to the main support member 66 and held in place thereon by the clamp 40.

Figure 6:
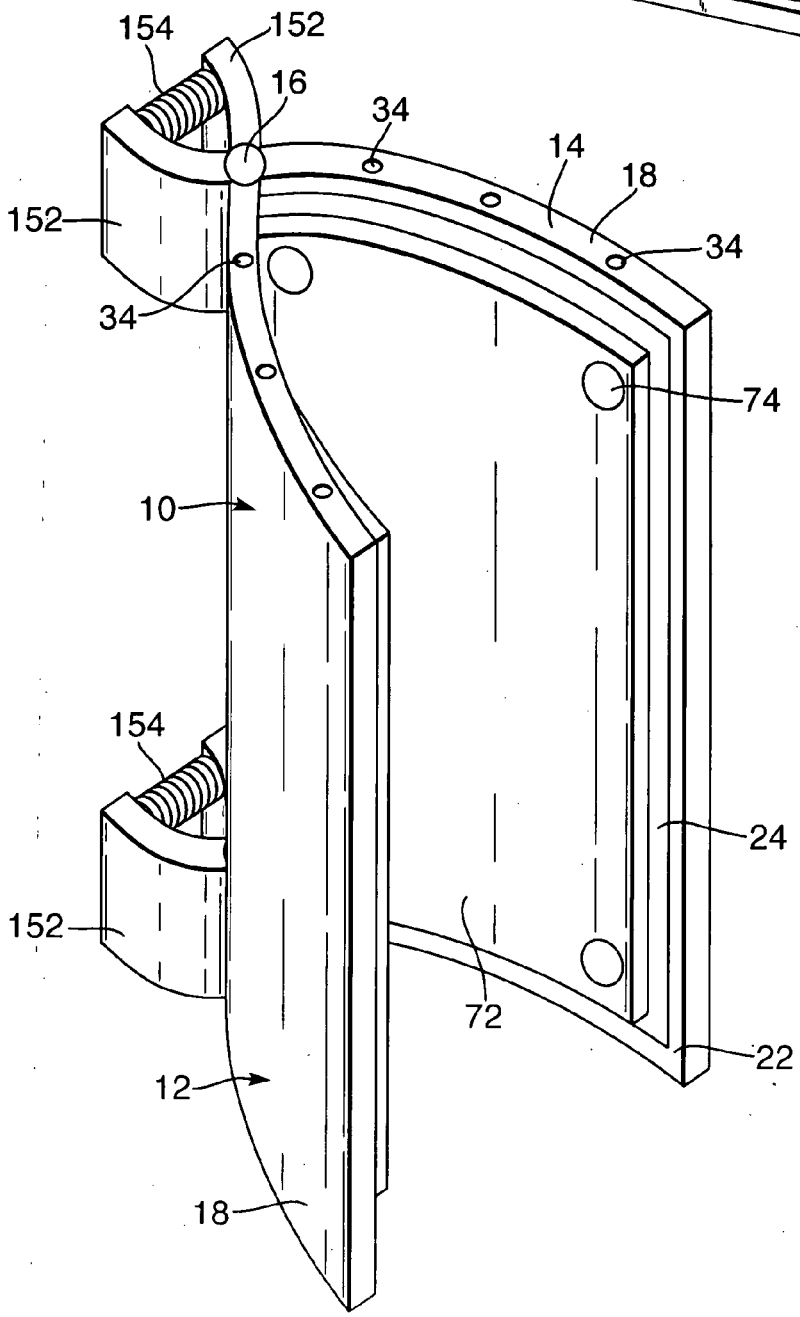
FIG. 6 shows a further embodiment of a surface treatment device.

Referring to FIG. 6, there is shown a further embodiment of the cassette 10 and the same features have been designated with the same reference numerals. The operation of FIG. 6 differs from the embodiment shown in FIGS. 1 to 4 in that a ceramic inner dispenser 72 is provided. The ceramic dispenser 72 is formed of a porous ceramic material such as aluminosilicate.

The ceramic dispenser 72 is cast in-situ on the blade 60 by the use of a suitably configured forming tool. A release agent may be provided to prevent the dispenser 72 bonding either to the fan blade 60 or the forming tool. After the formation of the dispenser 72, the cassette 10 is then arranged over it, as shown in FIG. 6. As can be seen, the cassette 10 shown in FIG. 6 differs from the cassette 10 shown in FIG. 1, in that a separate clamp 40 is not required, because of the provision of rearwardly extending engagement members 152 which are engaged by a spring 154 to push the holding portions 18 to their closed position in which they are sealed against the fan blade 60.

As can be seen the dispensing device 10 shown in FIG. 6 also includes seals 22 and inner liners 24.

In use, when the cassette 10 is clamped over the dispenser 72, suitable etching medium can be provided through the inlet apertures 34 to pass through the dispenser on to the leading edge region of the fan blade to be treated.

The pivot 16 is of a tubular configuration and is hollow so that it can be fitted over a main support member of a support arrangement, such as a jig 64 shown in FIG. 5.

It will be appreciated by the skilled person that, in the embodiment shown in FIG. 6, the ceramic dispenser 72 could be replaced by a paste 20 as described in FIG. 1, or by a powder, to which the medium can be supplied. In such a case inert members 74 are provided to control the correct thickness of the paste 20. The inert members may be of a hemispherical configuration, and may be formed of a polymeric material.

The paste could be provided in a pack comprising two compartments, namely a first compartment holding an acid, and a second compartment holding titanium dioxide. The first and second compartments may be separated from each other by a seal or a membrane. The contents of both compartments can be mixed on breaking the seal or membrane. The seal or membrane can be formed of a polymeric material. Alternatively, the two compartments could be part of a pliable composite unit.

In another embodiment, the ceramic dispenser 72 could be replaced by a substrate on which the paste has already been provided. The cassette 10 would then press the substrate and the paste against the leading edge region of the fan blade to be treated. The embodiment involving the use of a substrate is described below.

Figure 7:
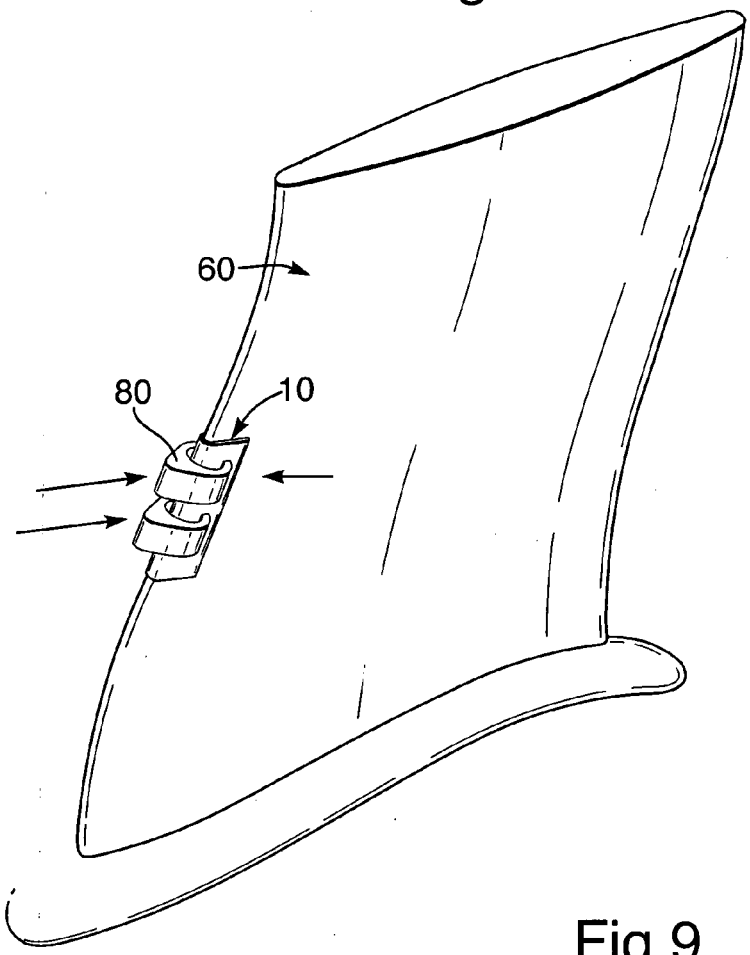
FIG. 7 shows another embodiment of a surface treatment device mounted on an article.
Figure 8:
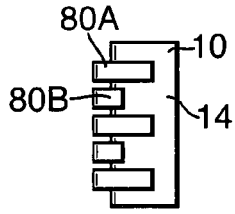
FIG. 8 shows surface treatment device including a securing arrangement.
Figure 9:
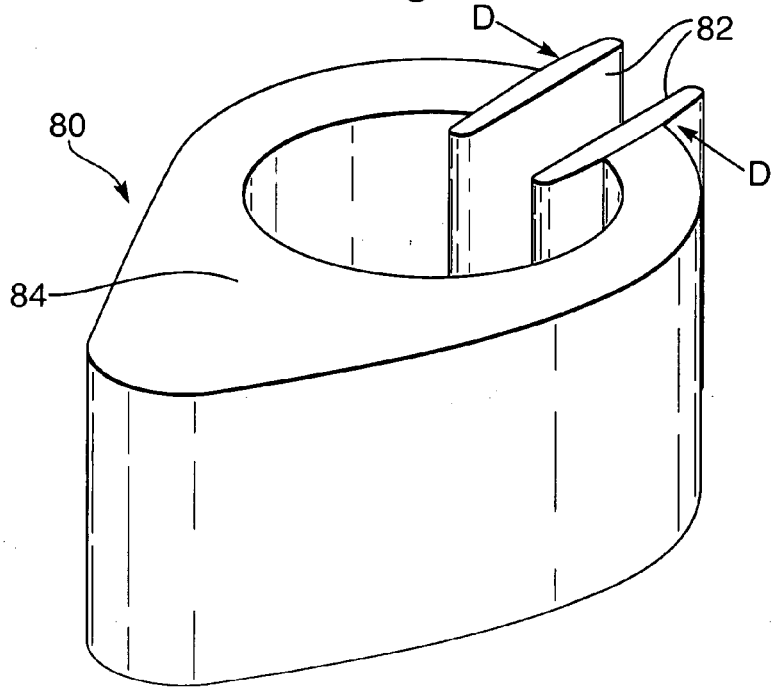
FIG. 9 shows an embodiment of a securing arrangement.

Referring to FIGS. 7, 8 and 9, there is shown a further embodiment. FIG. 7 shows a cassette 10 applied to the leading edge region of a fan blade 60. The cassette 10 is held in place by clamps in the form of clips 80, an example of which is shown in FIG. 9. FIG. 8 shows the arrangement of the clips 80 on the cassette 10. As can be seen, elongate clips 80A alternate with shorter clips 80B to provide clamping across the width of each of the application members 12, 14.

Referring to FIG. 9, the clip 80 comprises a pair of clamping members 82 which engage the respective application member 12, 14, and a spring portion 84 formed of a suitable plastics material to urge the clamping members 82 in the direction shown by arrows D.

Figure 10:
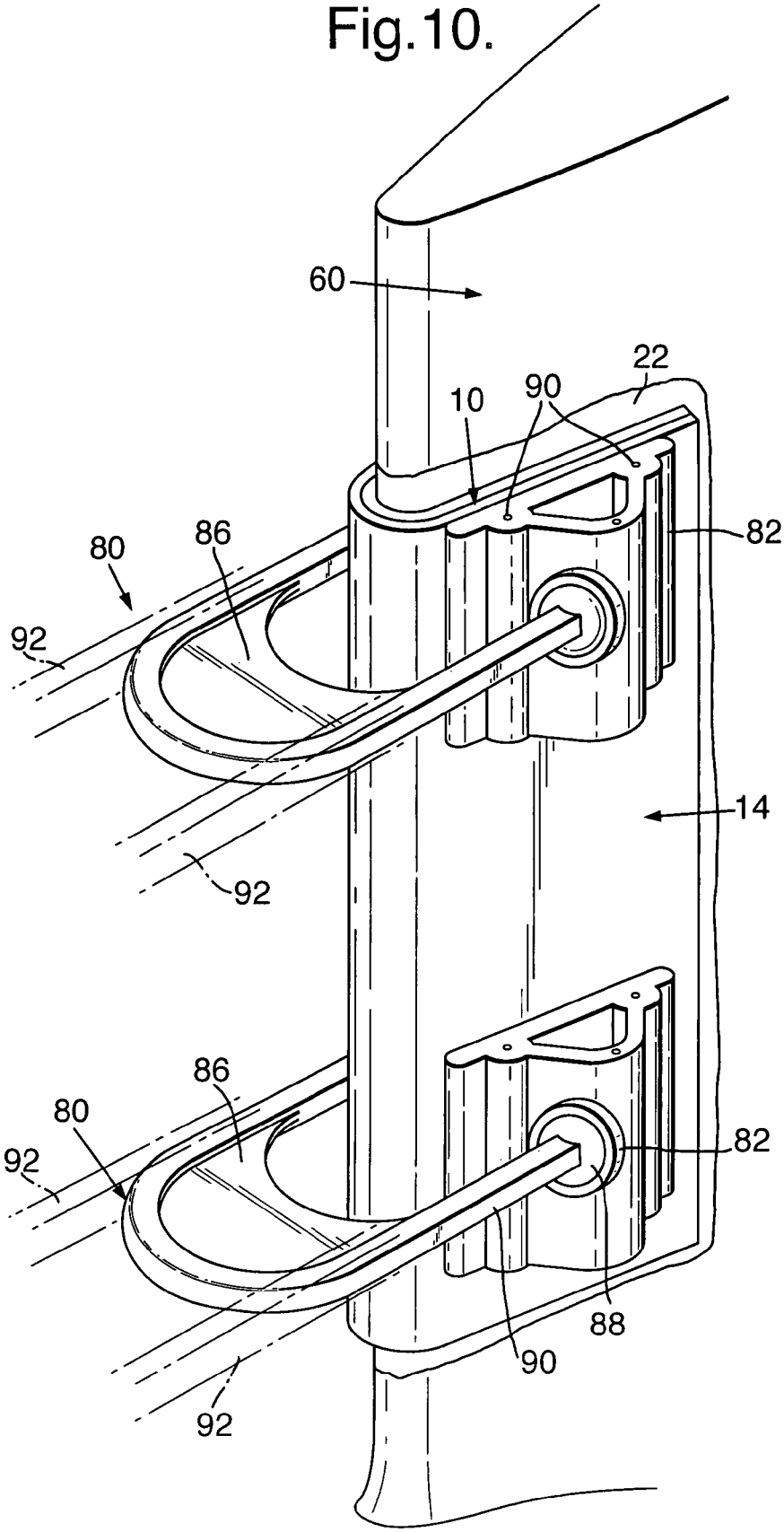
FIG. 10 shows a surface treatment device mounted on an article.

Referring to FIG. 10, there is shown a further embodiment, for clamping a cassette 10, similar to that shown in FIG. 7 to a leading edge of a fan blade 60. In the embodiment shown in FIG. 10, the clips 80 comprise a flanged portion 86 which provides the resilient urging of the clamping member 82 against the cassette 10.

A pivotal connection 88 is provided between connecting members 90 which extend from the clamping members 82 to the resilient portion 86 to allow different orientation of each of the clamping members 82. In addition to the gimble 80, hinged mounts 90 are provided to allow the clamping members 82 to further pivot. Guide rails 92, which extend from a support assembly 64 hold the clips 80 in place. Although FIG. 11 shows only three blades 60 on the disc 102, it will be appreciated by the skilled person that there would be an array of blades 65 conveyed one after the other circumferentially around the disc 102.

Figure 11:
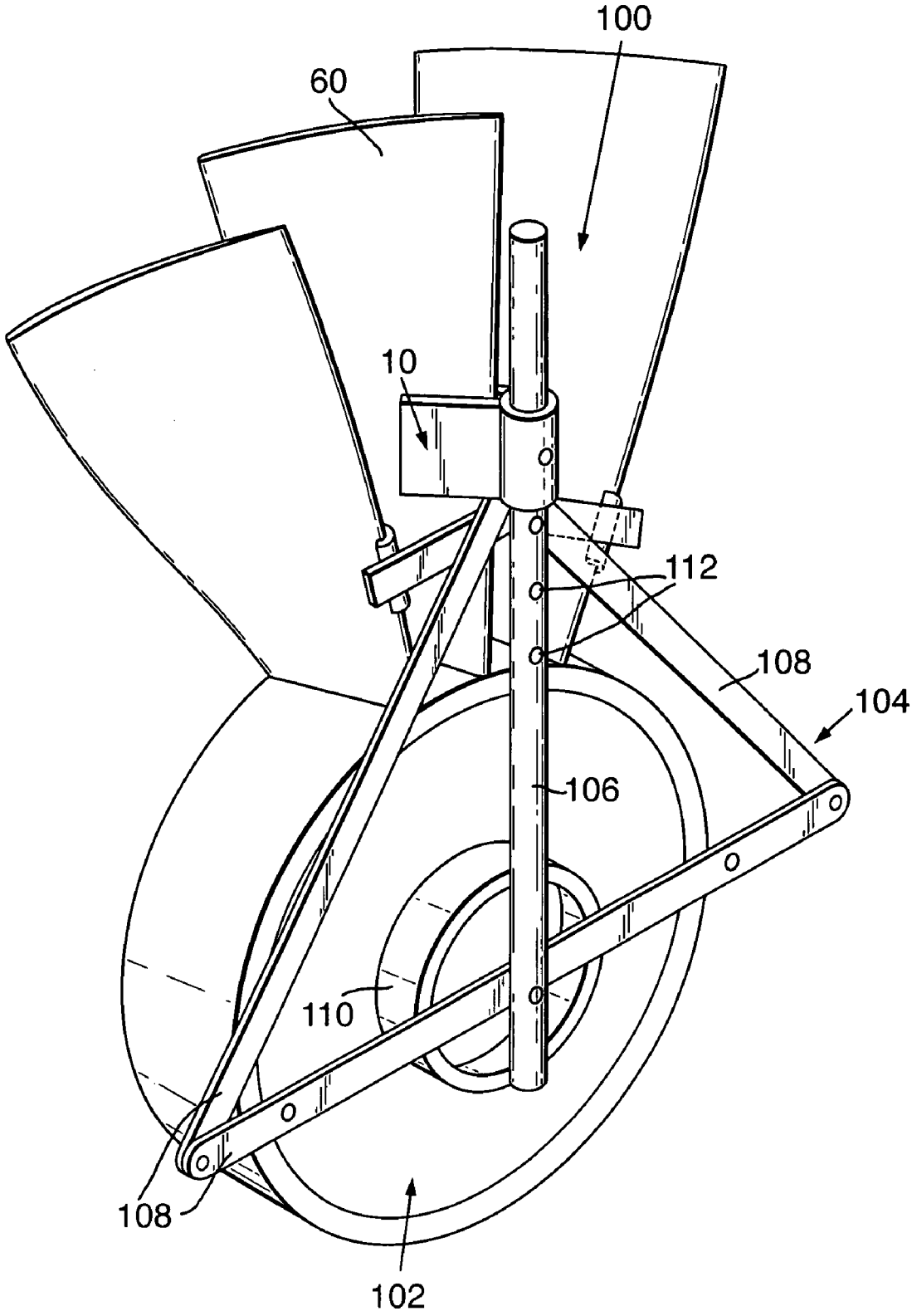
FIG. 11 shows an article with a support assembly for a surface treatment device.

Referring to FIG. 11, there is shown a surface treatment assembly 100 comprising a cassette 10 which engages a fan blade 60. The fan blade 60 is integrally mounted on a disc 102 such that the combination of the blade 60 and the disc 102 is referred to in the art as a blisk. The cassette 10 is supported by a support assembly 104 which comprises a main elongate support member 106 supported by a triangular arrangement of subsidiary support members 108. The support assembly 104 is mounted at the central region 110 of the blisk 102.

The main support member 106 defines along its length a plurality of apertures 112, at which a respective one of the cassettes 10 can be mounted.

Figure 12:
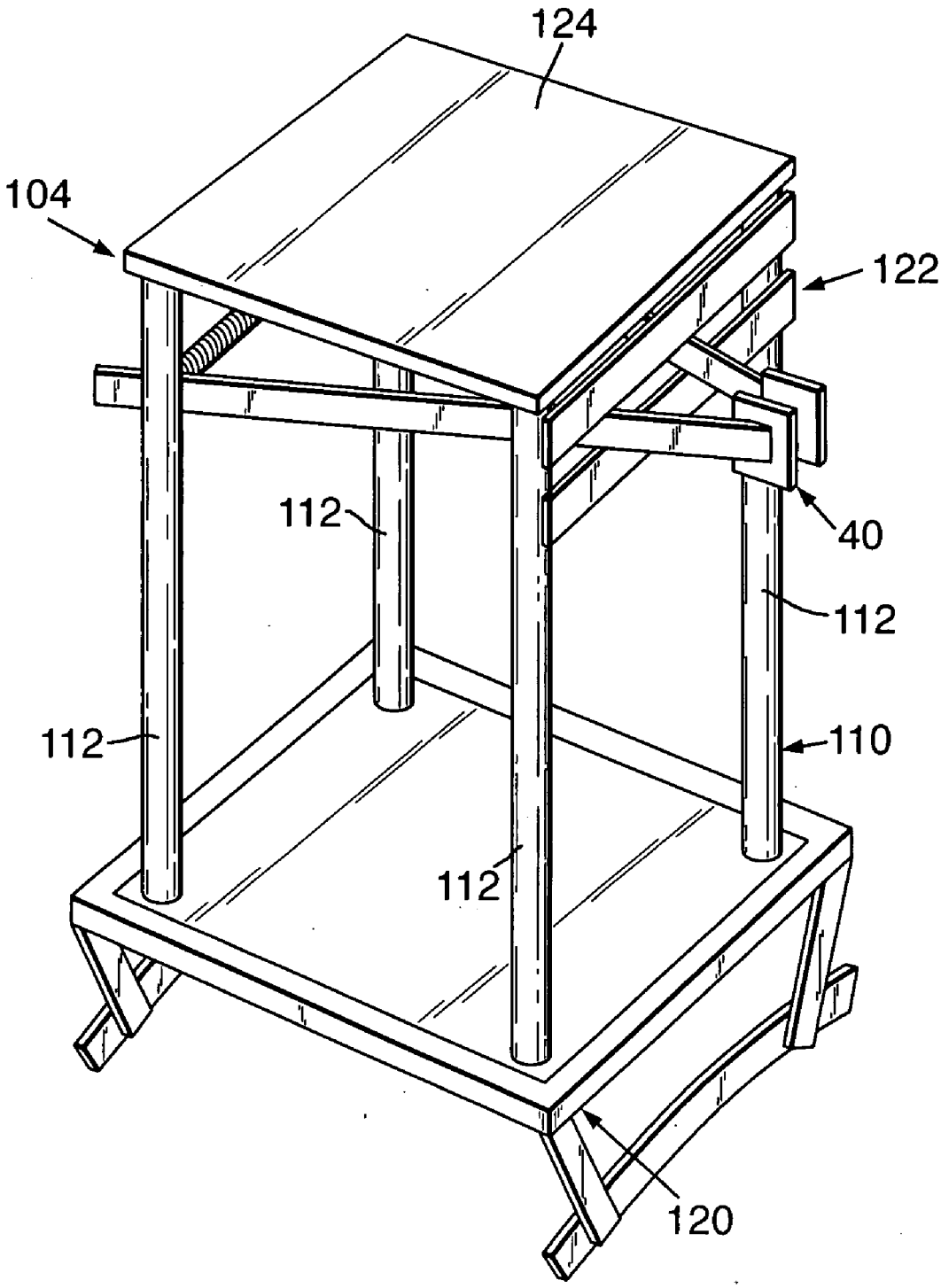
FIG. 12 shows a further embodiment of a support assembly.

Referring to FIG. 12, there is shown an embodiment of a support assembly 104 which comprises a rectangular base member 120 and an upstanding carrying arrangement 110 comprising four elongate support members 112 arranged in a square configuration relative to one another. The provision of the square arrangement of the subsidiary support members 112 allows the support assembly 104 to be used for curved fan blades.

The support assembly 104 shown in FIG. 12 comprises front and rear guide members 122 which can support a clamp 40. The guide members 122 can be arranged at differing heights of the support members 112 thereby supporting the clamp 40 at different radial heights of the fan blade 60. A lid 124 is provided on the support members 112 to hold them rigidly in position.

Figure 13:
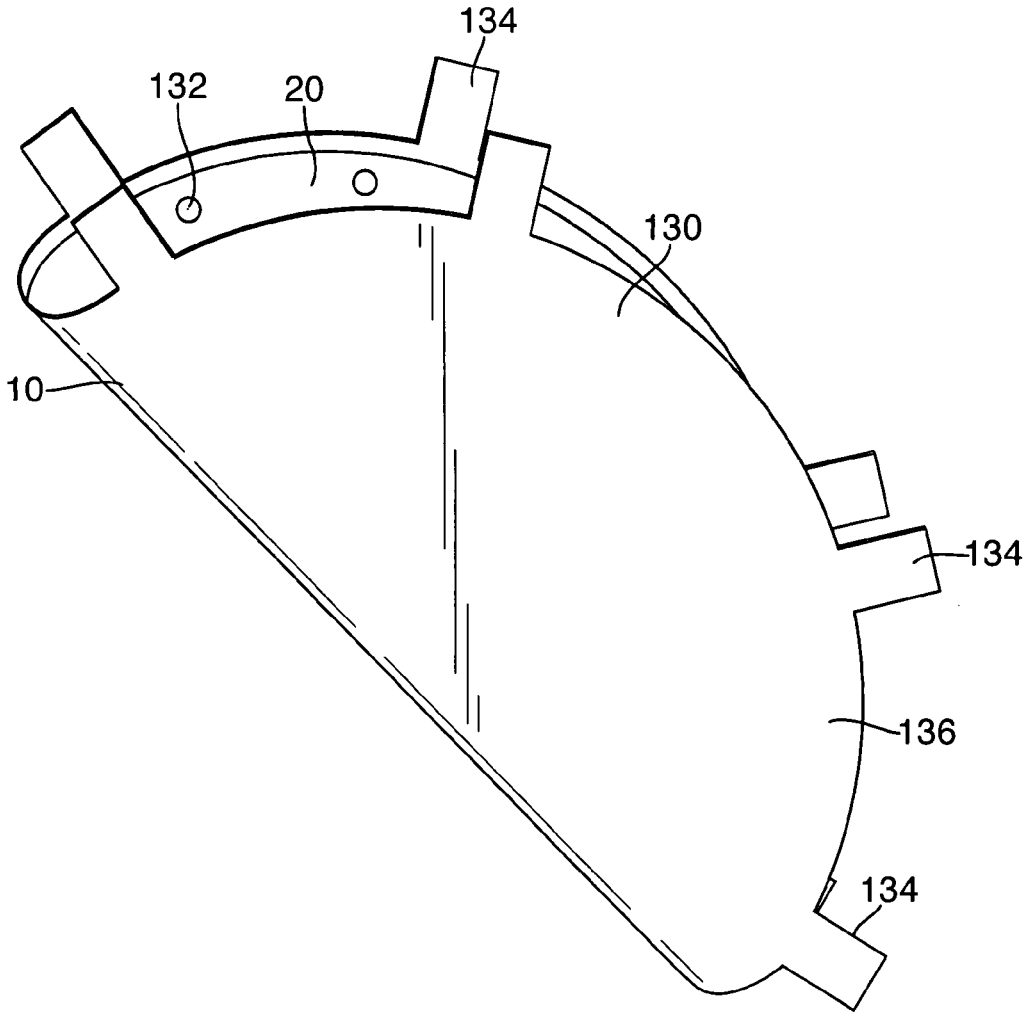
FIG. 13 is a diagrammatic view of a further embodiment of a surface treatment device.
Figure 14:
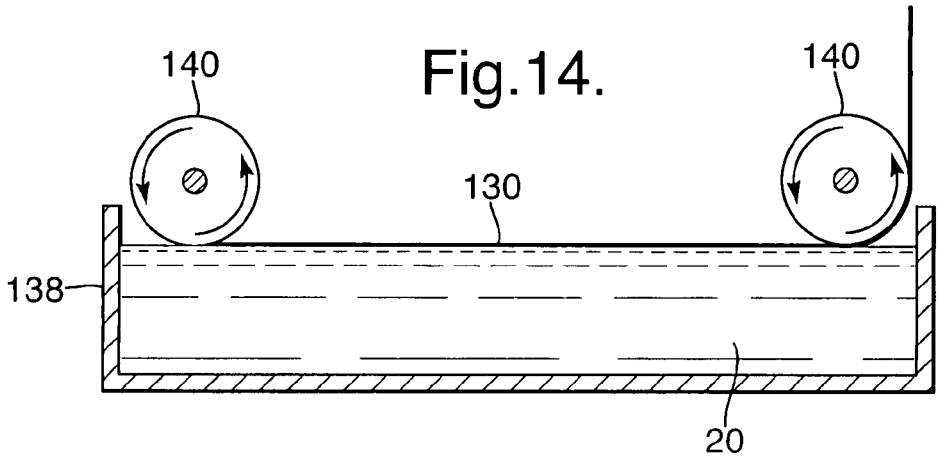
FIG. 14 is a diagrammatic representation of a method of forming the surface treatment device shown in FIG. 13.

Referring to FIGS. 13 and 14, there is shown a further embodiment of the surface treatment device 10, in which an etching medium in the form of a paste 20 is first applied to a substrate 130. The substrate 130 can be a metal foil of a tape of a plastics material.

The substrate 130 has spacers 132 thereon, which are in the form of hemispherical beads of plastics material. The spacers 132 provide a means to determine the correct depth of the paste 20.

The substrate 130 is of the correct size and shape to fit precisely over the area to be treated of the leading edge region of a fan blade 60.

In the embodiment shown in FIG. 13, the securing arrangement is in the form of tabs 134 which extend outwardly from a main part 136. The tabs 134 are coated with an adhesive to adhere the surface treatment device 10 shown in FIG. 13 to the leading edge region of the fan blade 60.

FIG. 14 shows a method for forming the surface treatment device 10 shown in FIG. 13.

A container 138 of an inert polymeric material is filled with the paste 20 of the etching medium. The substrate 130 is then arranged on the paste 20, and a roller 140 is rolled across the upper surface of the substrate 130. This causes the paste 20 to be coated onto the lower surface of the substrate 130 to the depth of the spacers 132. The substrate 130 can then be removed from the container 138 and folded to the correct shape of the region of the fan blade 60 to be treated.

Figure 15:
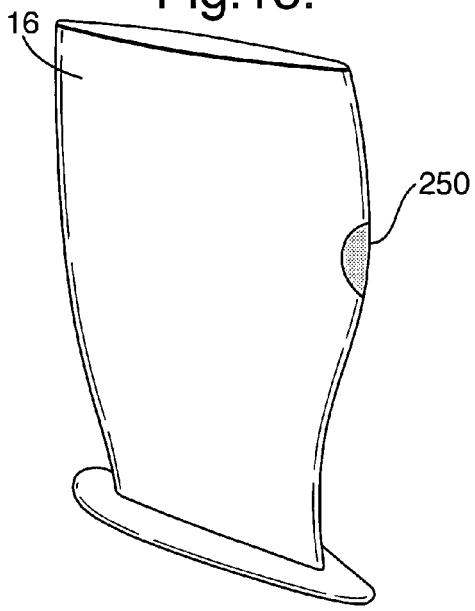
FIG. 15 is a perspective view of a fan blade.
Figure 16:
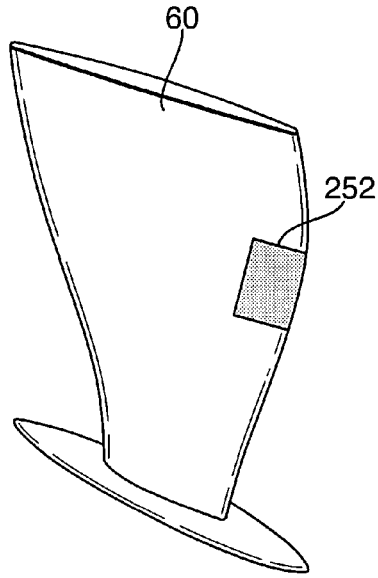
FIG. 16 is a perspective view of the blade shown in FIG. 15 with a ceramic dispenser applied thereto.

Referring to FIGS. 15 to 18 there is shown a further embodiment. In FIG. 15 a fan blade 60 is shown. The fan blade 60 comprises a repair region 250, which is in requirement of surface treatment by an etching medium. A ceramic dispenser 252 is formed by slip casting around the repair region 250.

Figure 17:
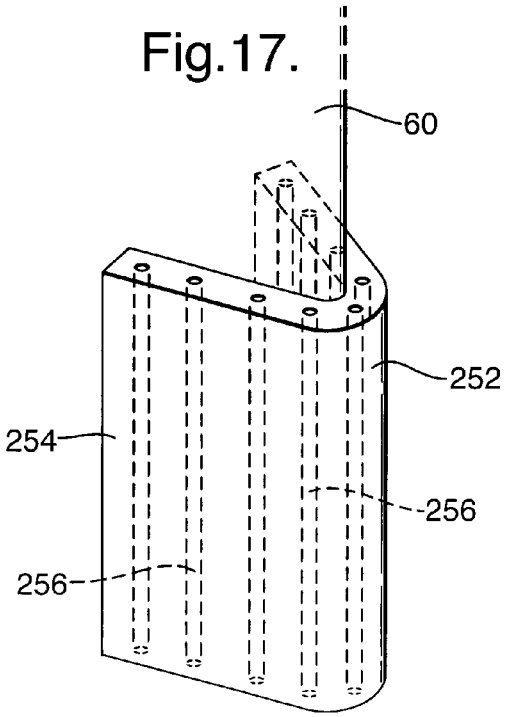
FIG. 17 is a close up view of the dispenser shown in FIG. 16.

FIG. 17 shows a close up view of the ceramic dispenser 252 just after formation by slip casting. The ceramic dispenser 252 has a main part 254 which has been cast around a plurality of glass rods 256. After formation of the ceramic dispenser 252 in a dried, but not fired state, the glass rods 256 are removed so that the main portion 254 defines a plurality of cylindrical conduits extending therethrough. The drying could be carried out by the application of an infra-red radiation thereto or by convection heating.

In the dried state, the ceramic dispenser 252 is porous and allows liquid to pass through the ceramic material.

Figure 18:
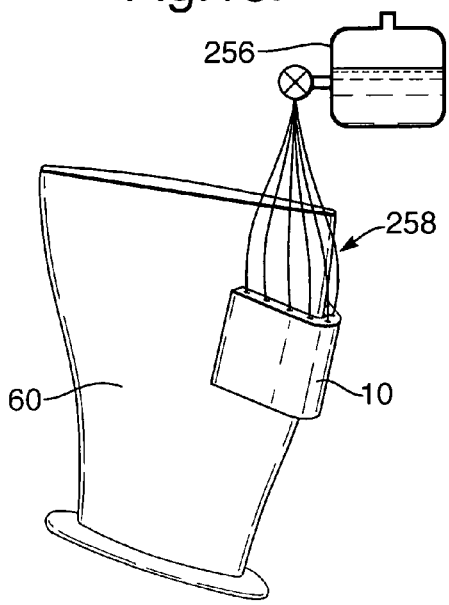
FIG. 18 is a perspective view of the fan blade shown in FIG. 16 with a surface treatment device applied thereto.

A surface treatment device 10, such as the surface treatment device 10 shown in FIG. 6 is then arranged over the ceramic dispenser 252 and clamped in position on the fan blade 60, as shown in FIG. 18. A supply 256 of a surface treatment medium is then arranged in fluid communication by a pipe arrangement 258 with the cassette 10. The surface treatment medium flows into the cylindrical conduits in the ceramic dispenser 252 and pass to the surface of the fan blade 60 for surface treatment thereof. After a pre-determined time, the surface treatment device 10 and the ceramic dispenser 252 can be removed.

Figure 19:
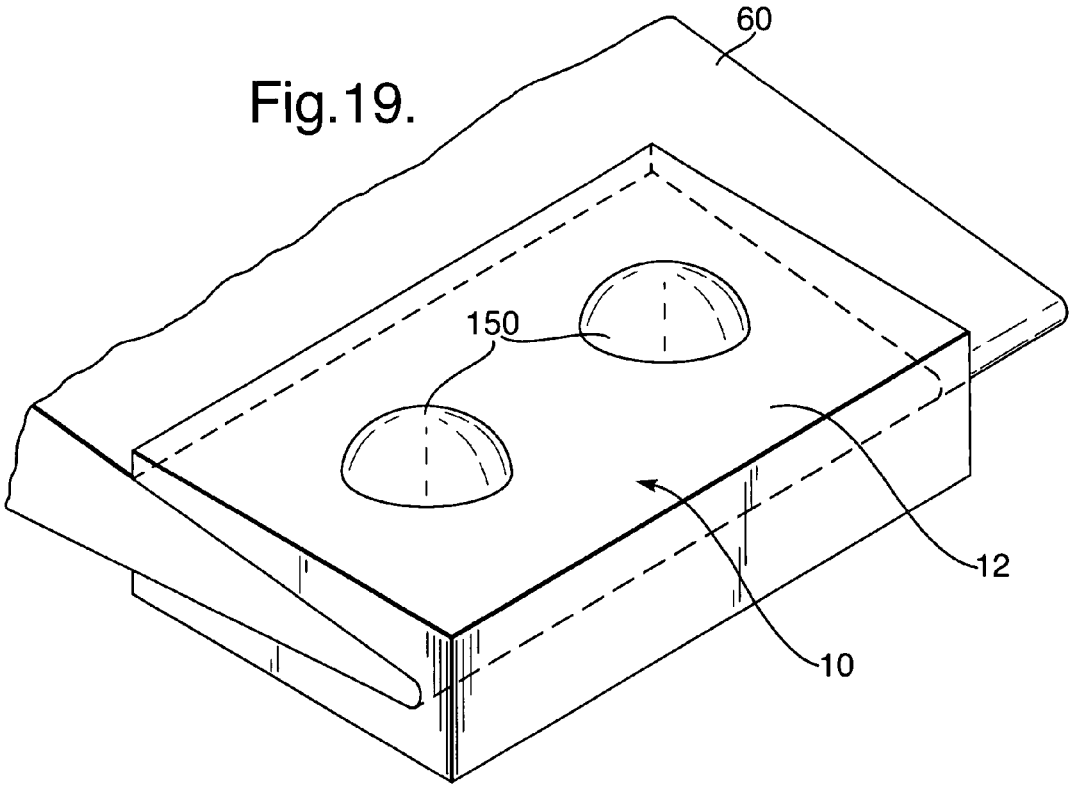
FIG. 19 is a diagrammatic perspective view of a further embodiment of a surface treatment device.
Figure 20:
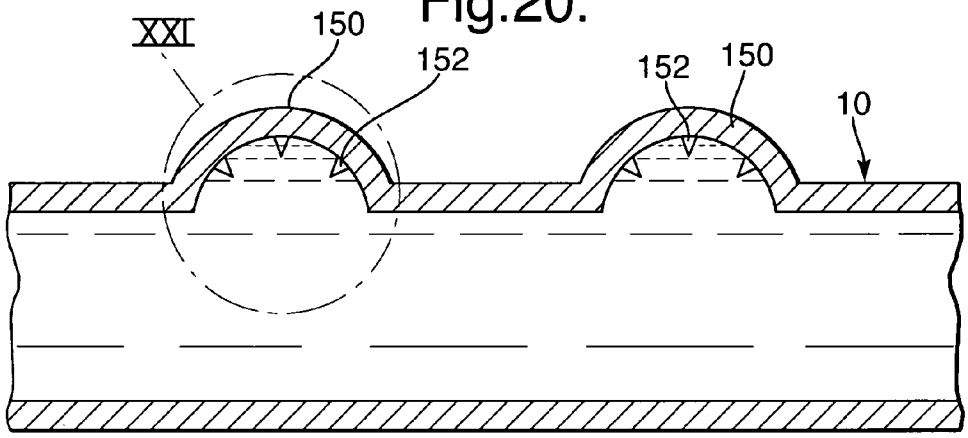
FIG. 20 is a diagrammatic cross-section view of the embodiment shown in FIG. 19.
Figure 21:
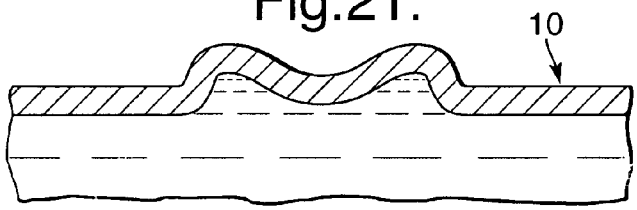
FIG. 21 is a view of the region marked XXI in FIG. 20 after operation of a feature therein.

Referring to FIGS. 19 to 21 there is shown a further embodiment of a surface treatment device 10 for applying a surface treatment medium to a blade 60. In this embodiment, a pair of mixing buttons 150 are provided to mix the surface treatment medium in the device.

The mixing buttons 150 are in the pliable polymeric glands and include bristles 152 on the inner surface thereof. The surface treatment device 10 has an internal width H that is determined by the viscosity of the surface treatment medium therein.

Each of the buttons 150 can be depressed to cause the surface to flow and thereby mix. FIG. 21 shows one of the buttons 150 having been depressed to effect the aforesaid mixing.

There is thus described an effective device for etching a repair on a leading edge of a fan blade which is environmentally friendly and inexpensive to use.

It is an advantage of the above described embodiments that they provide only localised treatment of a blade, and act in a fail safe manner. That is to say that the amount of material provided in the device will only act on the blade for a predetermined period of time and will not cause excessive damage if left unattended for a long period of time.

Various modifications can be made without departing from the scope of the invention. For example, the arrangement of the support members 108 shown in FIG. 11 need not be triangular.

We claim:

1. A surface treatment device for applying a surface treatment medium to an article, the surface treatment device comprising:

first and second application members for holding and applying the surface treatment medium to the article; and a securing arrangement comprising a clamp having a clamp member for securing the first and second application members to the article, wherein the securing arrangement comprises an urging member to urge each of the first and second application members into engagement with the article, the urging member is connected to the first and second application members, each of the first and second application members comprising a holding portion in which the surface treatment medium is held, the holding portion extends on one side of a pivot, and a reaction portion extends on an opposite side of the pivot from the holding portion.

2. A surface treatment device according to claim 1 wherein the urging member comprises a spring.

3. A surface treatment device according to claim 1, wherein each of the first and second application members comprises a reaction member in engagement with the urging member to be moved by the urging member thereby moving the holding portion.

4. A surface treatment device according to claim 1, wherein the clamp includes a clamping arrangement comprising first and second clamping members, each of the first and second clamping members engaging a respective one of the first and second application members.

5. A surface treatment device according to claim 4, wherein the urging member is provided on the clamping arrangement.

6. A surface treatment device for applying a surface treatment medium to an article, the surface treatment device comprising:

at least one an application member for holding and applying the surface treatment medium to the article; and a securing arrangement comprising a clamp having a clamp member for securing the at least on application member to the article, wherein a mixing arrangement is provided in each at least one application member to mix the medium, the mixing arrangement comprising an elongate element extending across at least a first and second of the at least one application member.

7. A surface treatment device according to claim 6 wherein a controller is provided to control movement of the elongate element.

8. A surface treatment device according to claim 7 wherein the controller comprises first and second magnets each arranged on a respective one of the first and second application members, the first and second magnets being movable along the respective one of the first and second application members to move the elongate member therewith.

9. A surface treatment device for applying a surface treatment medium to an article, the surface treatment device comprising:

at least one application member holding and applying an acid etching medium to a localized region of the article; and a securing arrangement comprising a clamp having a clamp member for securing the at least one application member to the article, wherein the at least one application member comprises a carrier to carry the acid etching medium, the carrier comprising titanium dioxide powder.

10. A surface treatment device for applying a surface treatment medium to an article, the surface treatment device comprising:

at least one application member for holding and applying the surface treatment medium to the article; and a securing arrangement comprising a clamp having a clamp member for securing the application members to the article, wherein a seal is provided around the edge of the at least one application member.

11. A surface treatment device according to claim 10, wherein the acid etching medium comprises at least one of nitric acid and hydrofluoric acid.

12. A surface treatment device according to claim 10, wherein the at least one application member is provided with inlet apertures to allow a flow of the acid etching medium therethrough.

13. A surface treatment device according to claim 10, wherein the seal comprises a moldable wax.

14. A surface treatment assembly according to claim 10, further comprising a support arrangement for supporting the surface treatment device on the article, the support arrangement comprising:

a jig, a main support member for supporting the surface treatment device, and subsidiary support members to support the main support member.

15. A surface treatment device for applying a surface treatment medium to an article, the surface treatment device comprising:

at least one application member holding and applying an acid etching medium to a localized region of the article; and a securing arrangement comprising a clamp having a clamp member for securing the at least one application member to the article, wherein:

the surface treatment device further comprises a substrate in the form of a tape or a foil, and a paste of the acid etching medium is provided on the substrate.

16. A surface treatment device for applying a surface treatment medium to an article, the surface treatment device comprising:

an application member for holding and applying the surface treatment medium to the article;

a securing arrangement comprising a clamp having a clamp member for securing the application members to the article; and a dispenser held by the application member, the dispenser being formed on the article, wherein the dispenser is formed of a ceramic material and defines passages therethrough for the surface treatment medium.

17. A surface treatment device according to claim 16, wherein:

the application member is arranged over the dispenser to hold the dispenser on the article, the surface treatment medium is supplied to the dispenser, and the ceramic material is porous to allow the surface treatment medium to pass therethrough.

18. A surface treatment device for applying a surface treatment medium to an article, the surface treatment device comprising:

an application member for holding and applying the surface treatment medium to the article;

a securing arrangement comprising a clamp having a clamp member for securing the application members to the article; and a mixing arrangement comprising a button on the application member, depression of the button causing a flow of the surface treatment medium, thereby mixing the surface treatment medium.

19. A surface treatment device according to claim 18 wherein the button comprises a flexible polymer material, and includes mixing members on the inner surface thereof to enhance the mixing.

20. A surface treatment device according to claim 18, wherein the button comprises a pair of buttons arranged adjacent each other on the application member.

* * * * *